US006111391A

United States Patent [19]

Cullen

[11] Patent Number: 6,111,391

[45] Date of Patent: Aug. 29, 2000

[54] CONTROLLER FOR SOLAR ELECTRIC GENERATOR FOR RECREATIONAL VEHICLES

[76] Inventor: Richard A. Cullen, 1058 Monterey Vista Way, Encinitas, Calif. 92024

[21] Appl. No.: 09/152,049

[22] Filed: Sep. 11, 1998

[51] Int. Cl.[7] ..... G05F 1/613

[52] U.S. Cl. ..... 323/223; 323/299; 323/906; 320/102

[58] Field of Search ..... 323/222, 223, 323/259, 299, 351, 906; 320/101, 102, 166

[56] References Cited

U.S. PATENT DOCUMENTS 5,270,636 12/1993 Lafferty ..... 323/299 X
5,530,335 6/1996 Decker et al. ..... 320/102

*Primary Examiner*—Jessica Han
*Attorney, Agent, or Firm*—John R. Ross; John R. Ross, III

[57] ABSTRACT

A controller for a solar electric generator that permits the generator to produce power substantially at its maximum capacity. Power is transferred from the generator to a temporary electric storage device that is periodically partially drained of power to maintain the temporary electric storage device at a voltage corresponding to the voltage needed by the generator to provide maximum generator power. The electric power drained from the temporary storage device is used to charge conventional batteries. In a preferred embodiment, the temporary storage device is a capacitor that is part of a buck regulator operating at 50 kHz with duty factor control between 0% and 100%. This buck topology switching type regulator provides the periodic draining. In the preferred embodiment control of the duty factor of the buck regulator is utilized to limit current, to prevent battery over charging, to test for the voltage corresponding to maximum power, and to operate the solar generator at is maximum power voltage. When operated at its maximum power operating point, the output to the battery is constant power, providing greater battery charge current than prior art controllers.

14 Claims, 3 Drawing Sheets

CONTROLLER FOR SOLAR ELECTRIC GENERATOR FOR RECREATIONAL VEHICLES

This invention relates to solar electric power generators and in particular to controllers for such generators.

BACKGROUND OF THE INVENTION

Solar electric generators (SG's) have been commercially available in the United States for about 25 years. These units generate electric power from the energy of sunlight, which is free. Attempts have been made to produce electric power from sunlight to supply utility electric grids but these efforts have been largely unsuccessful because the total cost per kilowatt-hour from the solar generators substantially exceed the cost per kilowatt hour for electric power generated at central generating stations powered by burning coal, oil, gas or by nuclear power plants.

The RV Market

However, when it is not feasible to hook up to a power grid fed by a central generating station, the solar electric generator is often the power source of choice. Competitive power sources include gasoline powered motor generating units and thermoelectric devices generating electric power based on the thermoelectric effect from a temperature difference. A very lucrative market for solar generators is to provide electric power for recreation vehicles (RV's) when the engine of the vehicle is not being utilized for travel. In this situation, the solar unit provides electric power (considering all applicable cost including depreciation maintenance, etc.) at a small fraction of the cost of operation the vehicle gasoline engine to charge the battery or batteries of the RV. The typical RV has one or two batteries. When there are two batteries, one is for the engine and one is for the "house" portion of the RV. A controller is needed to control the supply of electricity to the batteries.

Prior art controllers have typically been rather simple devices and not much effort has gone into utilizing controllers to maximize the efficiency of solar power generators. Perhaps, the thinking has been "why worry about efficiency when the energy (from the sun) is free?"

The typical prior art solar generating unit sold for RV units is designed to produce power at about 17 volts for charging 12-volt batteries. The typical control unit comprises control switches (either relay control switches or solid state control switches) for connecting the output of the solar generator to the battery and a control unit which monitors the battery voltage and opens the switch when the battery voltage reaches a high target voltage, such as 14 volts and closes the switch when the respective battery voltage drops to a low target voltage such as 13 volts. The prior art control units are also typically constructed with a series diode to assure that current does not flow in reverse through the solar generator discharging the battery at night.

Constant Current Generators

Most solar generating units are designed to operate in what is called constant current mode. This means that for a given level of solar radiation such as 1000 W/m$^2$, a substantially constant current is produced for any battery voltage within the design range of the solar generating unit. For example, FIG. 1 shows current vs. voltage for a typical solar unit, which is the BP275 Module available from BP Solar with offices in Fairfield, Calif. This graph shows that in the sunshine of 1000 W/m$^2$ at a solar generator temperature of about 25° C., the current produced by this unit is about 4.7 amps for battery voltages between 0 and 14 volts. The current drops off slightly to about 4.5 amps at 17 volts and drops to substantially zero at 21.4 volts. This is referred to as the open circuit voltage. Power is the product of current and voltage. Thus, if the battery being charged is at a low voltage level the rate of power delivery, and hence charging, can be substantially reduced.

What is needed is a better controller permitting the solar generating unit to function safely at or near its maximum power capacity.

SUMMARY OF THE INVENTION

The present invention provides a controller for a solar electric generator that permits the generator to produce power substantially at its maximum capacity. Power is transferred from the generator to a temporary electric storage device that is periodically partially drained of power to maintain the temporary electric storage device at a voltage corresponding to the voltage needed by the generator to provide maximum generator power. The electric power drained from the temporary storage device is used to charge conventional batteries. In a preferred embodiment, the temporary storage device is a capacitor that is part of a buck regulator operating at 50 kHz with duty factor control between 0% and 100%. This buck topology switching type regulator provides the periodic draining. In the preferred embodiment control of the duty factor of the buck regulator is utilized to limit current, to prevent battery over charging, to test for the voltage corresponding to maximum power, and to operate the solar generator at is maximum power voltage. When operated at its maximum power operating point, the output to the battery is constant power, providing greater battery charge current than prior art controllers.

DETAILED DESCRIPTION OF THE PREFERRED EMBODIMENT

First Preferred Embodiment

Figure 2:
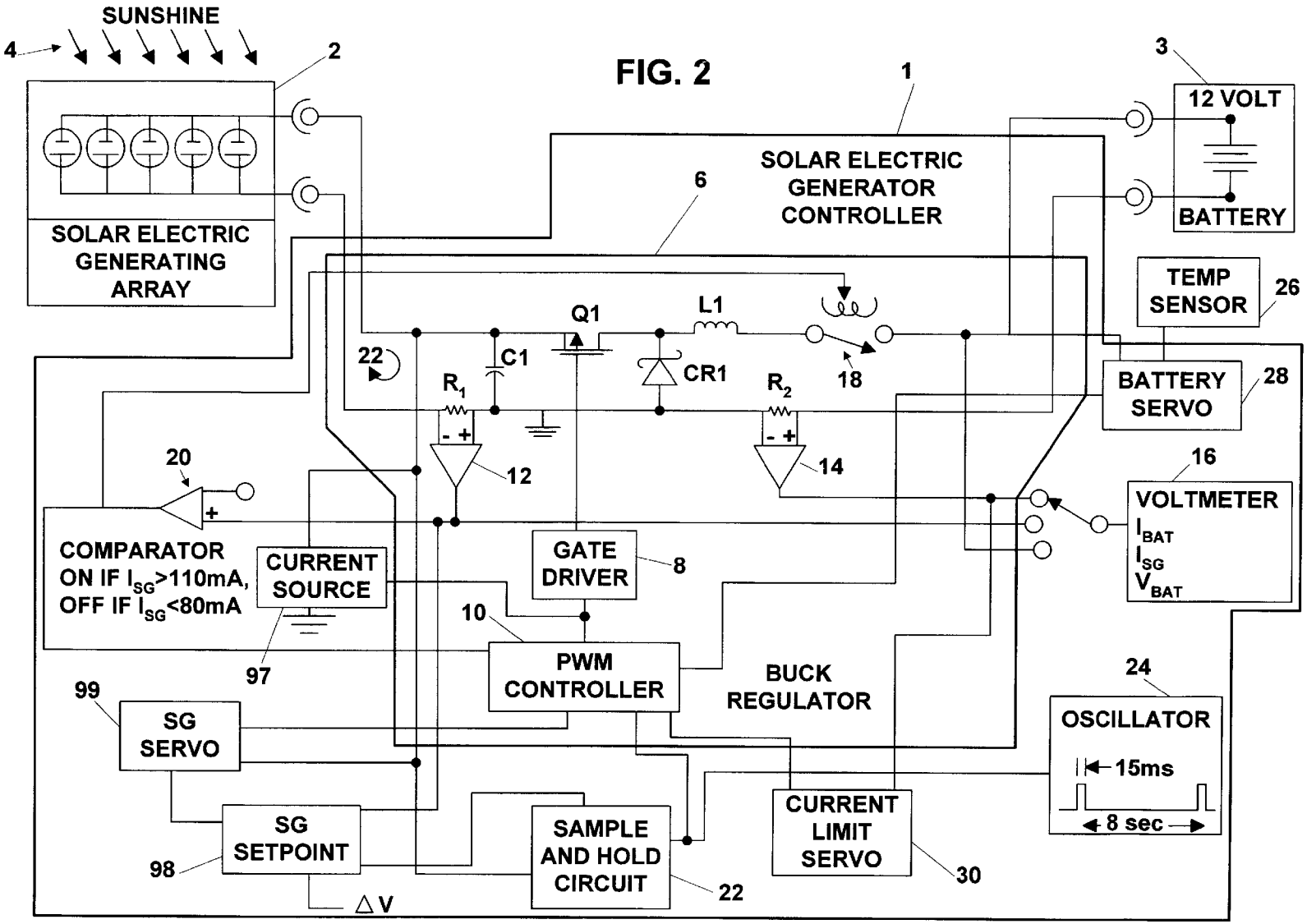
FIG. 2 shows a simplified functional drawing of a preferred embodiment of the present invention.

A first preferred embodiment of the present invention is described in FIG. 2. This unit is designed to extract the maximum energy from a solar generating unit (such as the BP275 solar generator) which can be used for providing solar power for RV vehicles.

Figure 1:
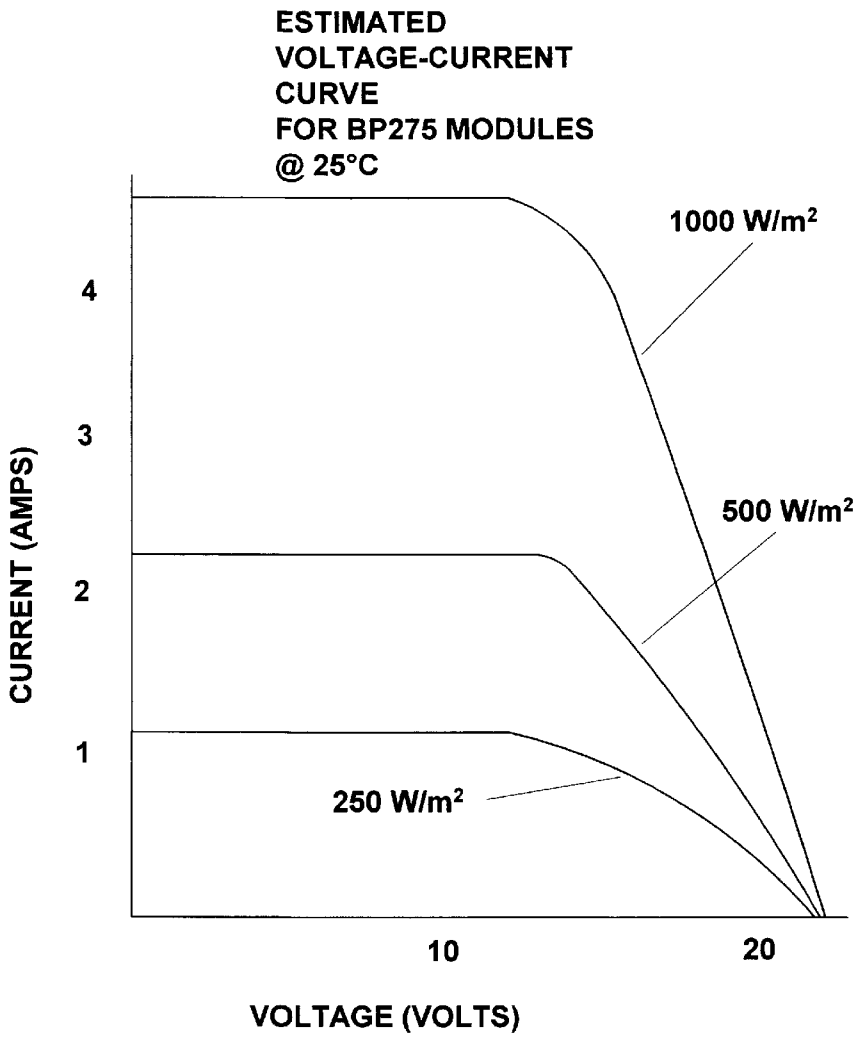
FIG. 1 shows an estimated Voltage-Current curve for BP275 Modules at 25° C.
Figure 1A:
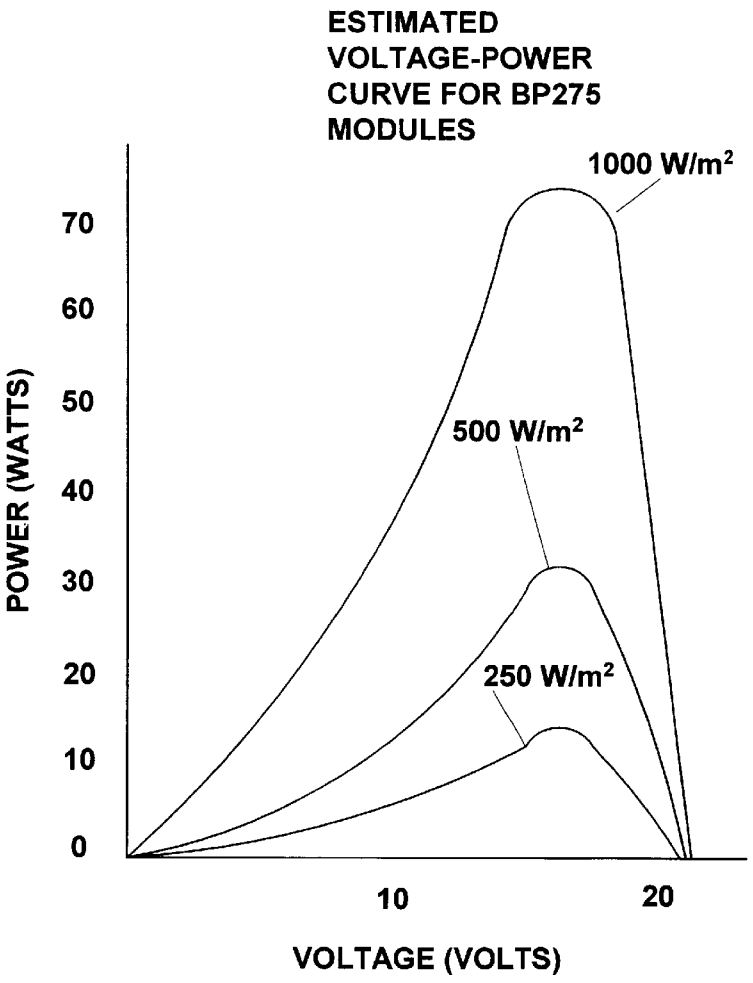
FIG. 1A shows an estimated Voltage-Power curve for BP275 Modules .

The data displayed in FIG. 1 was used to plot the curves in FIG. 1A. FIG. 1A reveals that (at 1,000 W/m$^2$ and 25° C.) the unit provides the maximum power at about 17 volts. At 17 volts, 1,000 W/m$^2$ and 25° C., the power (which is the product of current and voltage) is about 75 watts. (In terms of energy production this would be 75 watt-hours/hour). However, at 10 volts the power production is only 40 watts and at 20 volts the power production is also only 40 watts. FIG. 1A also shows the power vs. voltage curve for 500 and 250 W/m$^2$.

The present invention recognizes the importance of operating the solar generating unit at its maximum power voltage ($V_{MP}$) which in this case (at 1000 W/m$^2$ and 25° C.) is about 17 volts. $V_{MP}$ does not vary very much with solar radiation levels, but varies significantly and predictably with array temperature.

Figure 3:
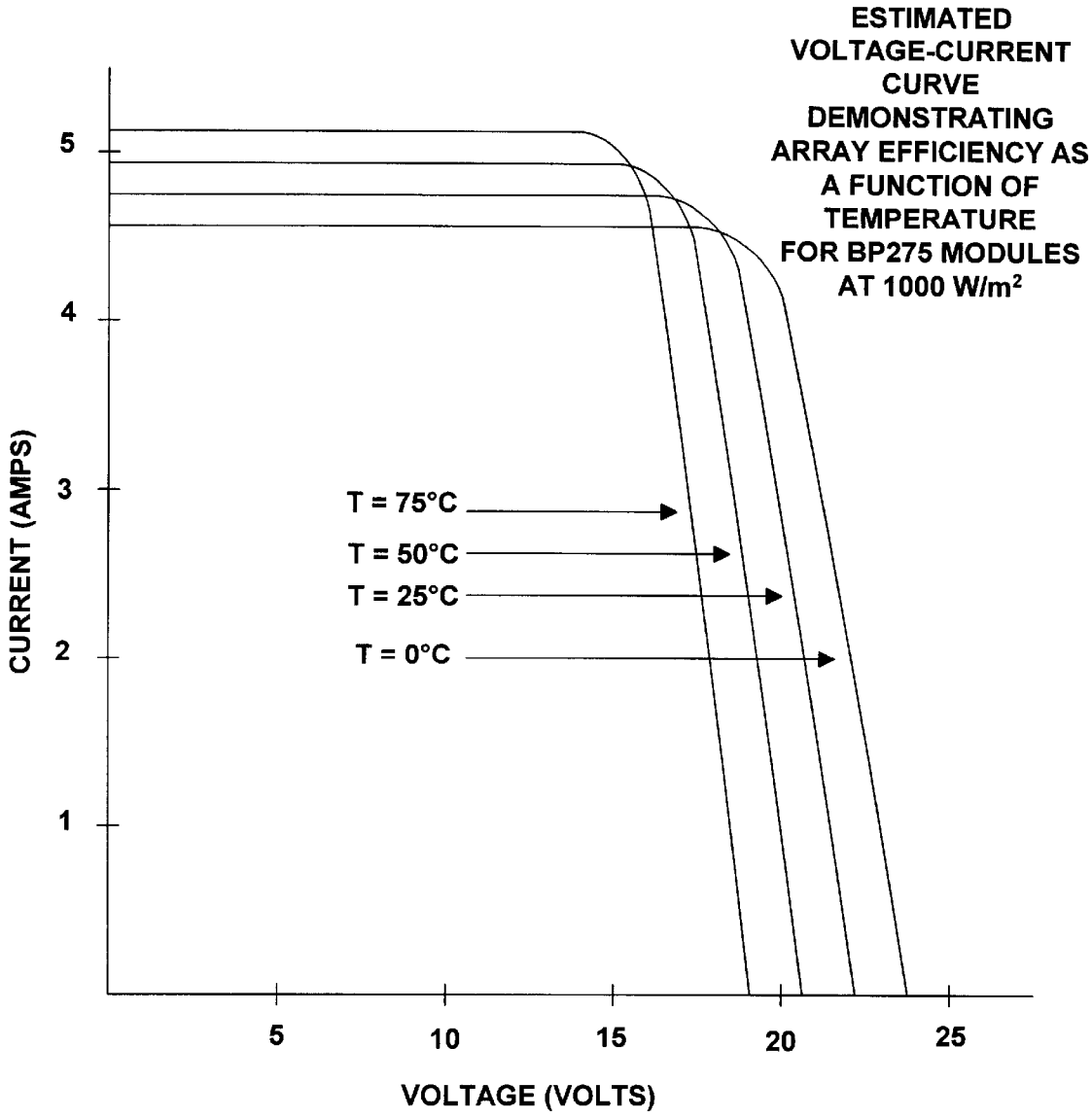
FIG. 3 shows an estimated Voltage-Current curve demonstrating array efficiency as a function of temperature for BP275 Modules at 1000 W/m$^2$.

As shown in FIG. 3 the open circuit voltage changes substantially with array temperature. However, the difference between SG open circuit voltage $V_{OC}$ and $V_{MP}$ is essentially constant regardless of array temperature. The actual operating point $V_{MP}$ is determined in this system by periodically sampling $V_{OC}$, which changes with SG temperature, then subtracting the difference between a particular SG panel's datasheet values of $V_{OC}$ and $V_{MP}$ from the sampled $V_{OC}$. The delta between $V_{OC}$ and $V_{MP}$ for the BP275 SG panel is approximately 4.4 volts. Applicant has determined that for the BP275 unit and similar units $V_{MP}$ is about 4.4 volts below the open circuit voltage at each radiation level over a wide range of levels from 1000 W/m$^2$ down to about 50 W/m$^2$.

In many installations, several units like the BP275 are operated in parallel so that sufficient power can be generated under minimum radiation conditions. This means that when the sun is very bright, in summer at mid-day and with no clouds, the current generated may exceed the current carrying capacitance of the charging circuits. Applicant's controller deals with this issue.

Simplified Functional Drawing

FIG. 2 is a simplified functional drawing of this preferred embodiment of the present invention. A solar generator 2 comprising five parallel BP Solar Modules generates electric power for charging battery 3 from solar radiation 4 at voltages ranging from 0 to about 21.4 volts. Referring to FIG. 2, controller 1 includes a buck type switching voltage regulator 6 consisting primarily of a 43 $\mu$H inductor L1, a bucking capacitor C1, a field effect transistor Q1, a circulating diode CR1, a gate driver 8, a pulse width modulation controller 10 and a relay control switch 18. Within the basic buck regulator there are two current sensing resistors, R1 and R2, which measure solar generation (SG) current (input current to the buck regulator), and battery current (output current from the buck regulator) by means of differential amplifiers 12 and 14. The differential amplifiers produce voltages proportional to current through their respective resistor, which feed other circuit elements. One of the circuit elements fed by the differential amplifiers is a three and one-half digit voltmeter 16. This meter also reads battery voltage. Battery voltage is displayed to 10-millivolt resolution, whereas SG current and battery current are displayed to 100 milliamps resolution.

Whenever photons of sunshine illuminate the solar panels of solar electric generator array 2, each of the five panels of the generator will produce a quantity of electric current as indicated by FIG. 1. The total current is the sum of the current produced by each of the panels. The current produced is primarily dependent on the radiation level and the voltage on bucking regulator C1 and to a lesser degree, the temperature of the solar array.

In early morning when the sun begins to illuminate array 2, the array begins to charge bucking capacitor C1. Comparator 20 closes relay switch 18 when the $I_{SG}$ current reaches 110 milliamps and the voltage on capacitor C1 has reached 14 volts. Current source 97 has a saturation voltage of approximately 14 volts. Therefore, current will not flow until available voltage is approximately 14 volts. The voltage on bucking capacitor C1 determines the current flowing in circuit 22, in accordance with FIG. 2. As indicated above, a principal element of this invention is to assure maximum power transfer from a solar electric generator array 2 to bucking capacitor C1. This is in general accomplished by having Q1 operate at 50 kHz and at a duty cycle such that the voltage on C1 is maintained at a target voltage chosen to assure maximum power transfer from solar array 2 to bucking capacitor C1. Current is allowed by transistor Q1 to flow to battery 3 at a rate as necessary to assure that C1 remains at the proper target voltage. Inductor L1 limits the current flow at the beginning of each cycle of the duty cycle of transistor Q1 and serves as an energy storage unit in the buck regulator.

Once the charging system turns on, it remains enabled as long as SG current is greater than approximately 80 milliamps. This hysteresis of approximately 30 milliamps in turn on/off threshold assures that operation will be stable near the turn on/off transition range. If current through R1 drops below 80 milliamps, comparator 20 shuts the generator down.

The required SG current should be available at this relatively high voltage of 14 volts to assure that charge current will flow to the battery. If the on/off decision was based on short circuit current, partial shading of SG array 2 would produce sufficient current for the system to turn on under SG short circuit conditions, but current would not flow to the battery since partial shading would prevent the SG array from developing a sufficiently high voltage to overcome battery voltage, causing the charge control system to turn off. Under these conditions the charge on/off control system would be unstable.

At very low radiation levels, relay switch 18 is open, duty cycle is clamped to 0% preventing current flow to the battery. However, the small quantity of SG current generated is allowed to flow through an on/off controllable sinking current source 97. Current source 97 has a soft saturation voltage of approximately 14 volts and a current limit of approximately 140 milliamps. It is enabled whenever PWM duty cycle is less than approximately 20 percent and is disabled whenever PWM duty cycle is greater than approximately 20 percent. When the charge control system is off, the PWM duty cycle is clamped to 0%. At this point, current source 97 is on and it, in combination with R1, differential amplifier 12, and $SG_{ON}$ comparator 20, essentially search for sufficient SG voltage and current. If it is available, controller 1 turns on. Current source 97 also provides the function of maintaining a minimum SG current for controller 1 to remain on if duty cycle goes to 0% due to unusually high battery voltage, i.e. greater than setpoint. This assures that controller 1 will remain on whenever sufficient SG current and voltage are available regardless of PWM duty cycle. This also assures that current source 97 is turned off when the controller is delivering charge current to the battery and duty cycle is in the normal operating range of 50–100%.

Pulse Width Modulator Controller

The PWM control system of the switching regulator uses a PWM device that attempts to deliver 100 percent duty cycle at all times. It is configured in such a way that duty cycle can be limited by five separate controlling inputs. The analog OR'ing function is such that whichever of the five inputs is attempting to decrease PWM duty cycle, will override other inputs requesting greater duty cycle. The inputs that can reduce duty cycle are: 1) SG open circuit voltage sample pulse, 2) peak power SG voltage control, 3)

$SG_{ON}$ comparator output low, 4) battery voltage control, and 5) output current limit.

(1) Open Circuit Measurement

As shown in FIG. 2, an approximation of the open circuit voltage of array 2 is measured every eight seconds by sample and hold circuit 22 based on a 15 ms signal from oscillator 24. PWM controller 10 reduces the duty cycle on Q1 transistor to zero for the 15 ms sample period to obtain the open circuit voltage approximation. During this 15 ms period the charge on C1 increases to approximately open circuit voltage and the voltage reading is stored by sample and hold circuit 22. After the 15 ms period, PWM controller 10 returns to normal operation.

(2) Peak Power Voltage Control

When SG voltage is sufficiently high, relative to battery voltage plus system voltage drops, such that 100% PWM duty cycle would produce an SG voltage below the maximum power voltage ($V_{MP}$), SG setpoint block 98 and SG servo block 99 reduce duty cycle such that SG voltage increases to $V_{MP}$, and is servo controlled at this value.

The proper $V_{MP}$ setpoint is determined by SG setpoint block 98. SG setpoint block 98 has three inputs which are used to determine the $V_{MP}$ setpoint for the SG peak power voltage control SG servo 99. These inputs are; the sampled value of $V_{OC}$ as described above, a voltage proportional to SG current derived from resistor R1 and differential amplifier 12, and a user programmable voltage ΔV. ΔV is the difference between SG datasheet values of $V_{OC}$ and $V_{MP}$ and is substantially constant for the full expected SG temperature range as shown in FIG. 3. The user programs this value into the controller at the time of installation, which is 4.4V for the BP275 SG. The output of SG setpoint block 98 is equal to; ((sampled $V_{OC}$)−ΔV - (0.07V/amp of SG current)). The 0.07V/amp of SG current correction factor decreases SG servo setpoint voltage to compensate for voltage drop in cabling between the controller and the SG. Due to cost, manageable wire size, etc., a typical installation will produce approximately a 0.7 volt drop at 10 amps between the SG and the controller terminals. Since the controller servos $V_{MP}$ at the controller terminals, actual SG voltage will typically be 0.7 volts higher than the desired SG voltage at the SG array terminals, at an SG current of 10 amps. This is also key to the invention as the correction factor eliminates the need for remote sensing of actual SG voltage.

The SG voltage setpoint feeds SG servo block 99, which controls the PWM duty cycle to maintain SG voltage at $V_{MP}$. Note that the SG servo operates in a reverse polarity to a typical servo since lower SG voltage requires a decrease in duty cycle to raise SG voltage to the desired setpoint value.

Since under conditions of constant radiation and SG temperature the SG servo forces constant SG voltage at $V_{MP}$ regardless of battery voltage and current, the output operates as constant power due to the well understood characteristics of the traditional buck topology switching regulator. As battery voltage changes with constant SG input power, PWM duty cycle changes to maintain constant SG power. Since output power is essentially constant, a decrease in battery voltage produces an increase in charge current going to the battery. This application of buck topology power conversion technology is key to the invention.

But, whenever SG voltage is not sufficiently high, relative to battery voltage plus system voltage drops, such that a 100% PWM duty cycle produces a SG voltage above the maximum power voltage ($V_{MP}$), the SG servo saturates at 100% PWM duty cycle, and the system reverts to straight through direct connection to the battery the same as prior art. If the voltage becomes high enough, battery voltage servo limits and controls the voltage.

A key to proper sampling at low SG currents is the need to minimize the size of C1 so that zero SG current is flowing at the end of the sample pulse. In this application the United-Chemicon URZA series capacitor is used due to its very high ripple current capability at relatively low capacitance values. This unique capacitor allows proper $V_{OC}$ sampling, and therefore proper boost operation, at SG currents as low as 0.8 amps, while having a suitably high ripple current rating for long life in a 20 amp buck converter. Another key requirement to keeping the minimum SG current required for boost operation low is a large enough value of L1 relative of switching frequency to keep the buck converter in a continuous conduction operating mode. The combination of a 50 KHz operating frequency and 43 μH L1 inductor maintains continuous conduction under normal operating conditions down to an output current of approximately 0.9 amps. Therefore boost reliably operates down to an output current of just under 1.0 amp.

(3) SG Comparator Output Low

SG comparator 20, in addition to providing a signal to operate relay switch 18, provides a low current signal at 80 mA to initiate a zero duty cycle of buck regulator 6. This means that the controllable current source 97 should be on all the time whenever controller 1 is off.

(4) Battery Voltage Servo

In this preferred embodiment the duty factor is also subject to reduction based on battery high voltage. This high voltage setting is preferably set based on data provided by the battery manufacturer. A battery temperature signal from temperature sensor 26 is used by battery servo 28 to establish the high voltage limit which is used to direct PWM controller to reduce the duty factor as the limit is approached. In the preferred embodiment, an analog circuit is used to provide the temperature adjustment but a digital processor could also be utilized. For example, the voltage limit of typical lead acid battery decreases by about 5 millivolt per cell for each ° C. rise in the battery temperature.

(5) Output Current Limit

This preferred embodiment provides a current limit servo 30 to provide a signal to PWM controller 10 to limit duty factor to limit the current in the charging circuit. In this embodiment the current limit is set at 21 amps. In the event this limit is reached current limit servo 30 will provide a signal to PWM controller 10 to limit the current to 21 amps.

While the present invention has been described in relation to a particular embodiment, persons skilled in the art will recognize that many potential variations are possible. For example, smaller or larger solar generating systems will require appropriate changes. A small rechargeable battery could be used in place of the C1 capacitor. The maximum power voltage could be determined periodically by forcing a voltage swing on C1 and measuring the current across R1 and then using recorded voltage and current values to calculate the maximum power voltage.

The present invention has many obvious applications other than RV's. All that is needed is a little sunshine and a location some distance from a utility power grid. For these reasons the scope of this invention is to be determined by the appended claims and their legal equivalents.

What is claimed is:

1. A recreational vehicle with solar electric generator comprising:

A) a gasoline powered engine,

B) a house portion,

C) at least one rechargeable battery,

D) a solar generation unit for generating electricity from solar illumination, and E) a controller for regulating the flow of electricity from said solar generating unit to said at least one battery, said controller comprising:

1) an interim electric storage means for receiving electric energy generated by said solar electric generator and temporarily storing said energy, 2) a controllable periodic electric charge drainage means for draining electric energy from said interim electric storage means into a battery, 3) an estimating means for estimating a target voltage of said interim electric storage means which will result in maximum transfer of power from said electric generating unit, and 4) a processor for controlling said drainage means so as to maintain said interim electric storage means at said target voltage.

2. A controller as in claim 1 whereas the interim electric storage means is a capacitor.

3. A controller as in claim 2, wherein said electric charge drainage means comprises a field effect transistor driven by a gate driver which is controlled by a pulse width modulation controller.

4. A controller as in claim 3 and also comprising a relay controlled switch to disconnect said battery from said generator.

5. A controller as in claim 3, wherein said controller is programmed via said gate driver to open and close said field effect transistor periodically with controllable open and close durations so as to define duty cycles ranging from 0 percent to 100 percent.

6. A controller as in claim 5, wherein said controller is configured such that said pulse width modulation controller receives input signals from a current limit servo.

7. A controller as in claim 5, wherein said controller is configured such that said pulse width modulation controller receives input signals from a battery servo.

8. A controller as in claim 2, wherein said estimating means comprises a means for obtaining an estimate of an open circuit voltage of said solar electric generator.

9. A controller as in claim 8, wherein said means for obtaining an estimate of an open circuit voltage comprises an oscillator for producing a periodic short pulse at a predetermined interval, a field effect transistor and a pulse width modulation controller programmed to open said field effect transistor during said short pulse.

10. A controller as in claim 9, wherein said target voltage is estimated by subtracting a predetermined voltage difference from said estimate of said open circuit voltage.

11. A controller as in claim 10 and also comprising a current measuring means for measuring the magnitude of current produced by said solar electric generator and said pulse width modulation controller is programmed to adjust said target voltage based on the magnitude of said current produced by said solar electric generator.

12. A controller as in claim 1, wherein the interim storage means is a rechargeable battery.

13. A controller as in claim 11 and also comprising a digital readout meter displaying on command, current to said battery, current delivered by said solar generating unit and battery voltage.

14. A recreational vehicle with solar electric generator comprising:

A) a gasoline powered engine,

B) a house portion,

C) at least one rechargeable battery,

D) a solar generation unit for generating electricity from solar illumination, and E) a controller for controlling the rate at which said generating unit charges said at least one battery, said controller comprising:

1) an interim electric storage means for receiving electric energy generated by said solar electric generator and temporarily storing said energy, 2) a controllable periodic electric charge drainage means for draining electric energy from said interim electric storage means into a battery, 3) an estimating means for estimating a target voltage of said interim electric storage means which will result in maximum transfer of power from said electric generating unit, and 4) a processor for controlling said drainage means so as to maintain said interim electric storage means at said target voltage.

* * * * *